US007932453B2

(12) United States Patent
Allred, III et al.

(10) Patent No.: US 7,932,453 B2
(45) Date of Patent: Apr. 26, 2011

(54) TOOL FOR SETTING AN INSTRUMENT SOUND POST

(75) Inventors: Jimmie B. Allred, III, Skaneateles, NY (US); Edmund Zielinski, Liverpool, NY (US)

(73) Assignee: Allred & Associates Inc., Elbridge, NY (US)

( * ) Notice: Subject to any disclaimer, the term of this patent is extended or adjusted under 35 U.S.C. 154(b) by 0 days.

(21) Appl. No.: 12/711,707

(22) Filed: Feb. 24, 2010

(65) Prior Publication Data

US 2010/0212476 A1 Aug. 26, 2010

Related U.S. Application Data

(60) Provisional application No. 61/155,712, filed on Feb. 26, 2009, provisional application No. 61/224,987, filed on Jul. 13, 2009.

(51) Int. Cl.
*G10G 7/00* (2006.01)
*G10D 1/02* (2006.01)

(52) U.S. Cl. ..... 84/458; 84/277

(58) Field of Classification Search ..... 84/277, 84/458; 294/19.1, 31.2
See application file for complete search history.

(56) References Cited

U.S. PATENT DOCUMENTS

| | | | | | |
|---|---|---|---|---|---|
| 152,934 | A * | 7/1874 | White | 7/164 |
| 455,822 | A * | 7/1891 | Weber | 7/127 |
| 1,466,681 | A * | 9/1923 | Todd | 84/277 |
| 1,556,340 | A * | 10/1925 | Myers | 84/277 |
| 1,559,657 | A * | 11/1925 | Todd | 84/277 |
| 1,816,723 | A * | 7/1931 | Dunoyer | 269/131 |
| 1,983,425 | A * | 12/1934 | Willis | 294/103.1 |
| 2,145,237 | A * | 1/1939 | Eberhart | 84/277 |
| 2,522,190 | A | 9/1950 | Mouser | |
| 3,224,404 | A * | 12/1965 | De Jong | 114/230.25 |
| 3,540,769 | A * | 11/1970 | Rosser | 294/19.1 |
| 4,600,008 | A * | 7/1986 | Schmidt | 606/162 |
| 4,732,150 | A * | 3/1988 | Keener, Jr. | 606/107 |
| 4,950,015 | A * | 8/1990 | Nejib et al. | 294/19.1 |
| 5,201,741 | A * | 4/1993 | Dulebohn | 606/113 |
| 5,538,302 | A * | 7/1996 | Travis | 294/24 |
| 5,586,514 | A * | 12/1996 | Yuscavage | 114/230.26 |
| 5,804,748 | A | 9/1998 | Clayton, Sr. | |
| 6,421,896 | B1 * | 7/2002 | Beyer | 29/213.1 |
| 6,482,239 | B1 * | 11/2002 | Jones et al. | 84/458 |
| 6,726,069 | B2 * | 4/2004 | Machover | 224/148.7 |
| 7,374,216 | B2 * | 5/2008 | Rousey et al. | 294/24 |
| 2009/0277319 | A1 * | 11/2009 | Beter | 84/277 |
| 2010/0212476 | A1 * | 8/2010 | Allred et al. | 84/458 |

* cited by examiner

*Primary Examiner* — Jeffrey Donels
*Assistant Examiner* — Robert W Horn
(74) *Attorney, Agent, or Firm* — Brown & Michaels, PC

(57) ABSTRACT

A tool for setting an instrument sound post preferably includes a bent tube, one or more string or polymer lines, a cradle end that grasps the sound post, and an internal locking mechanism to hold the sound post against the tool. In one embodiment, a single line is used and a closed loop at the cradle end of the sound post setting tool holds the sound post in place. In this embodiment, a double-chamfer threaded tube construction is preferably used to facilitate line threading. In another embodiment, the cradle end includes a loop and a ball to grasp the sound post. In yet another embodiment, the cradle end includes two balls to grasp the sound post. The tool provides an improved way to install a sound post inside a stringed instrument.

23 Claims, 16 Drawing Sheets

TOOL FOR SETTING AN INSTRUMENT SOUND POST

REFERENCE TO RELATED APPLICATIONS

This application claims one or more inventions which were disclosed in Provisional Application No. 61/155,712, filed Feb. 26, 2009, entitled "TOOL FOR SETTING AN INSTRUMENT SOUND POST" and Provisional Application No. 61/224,987, filed Jul. 13, 2009, entitled "TOOL FOR SETTING AN INSTRUMENT SOUND POST". The benefit under 35 USC §119(e) of the U.S. provisional applications is hereby claimed, and the aforementioned applications are hereby incorporated herein by reference.

BACKGROUND OF THE INVENTION

1. Field of the Invention

This invention relates to musical instrument repair tools, and in particular to tools for setting a stringed instrument sound post.

2. Description of Related Art

Violins and other stringed instruments containing sound posts have a long history dating back hundreds of years. Throughout this time, numerous tools and devices have been developed to aid the maker, as well as the repair person, to set sound posts within assembled instruments. The majority of sound post setting tools belong to one of two categories. The first category includes tools with a pointed end, where the point is stabbed into the sound post. These tools are typically referred to as S-shaped or S-type sound post setting tools. The second category includes tools with a cradle or other supporting member that stabilizes the sound post as it is inserted into the instrument.

Several patents have been issued for sound post setting tools. U.S. Pat. No. 152,934 (White) discloses a relatively straight sound post setting tool with a pointed end, as well as a combination jointed sound post setter and string gage. U.S. Pat. No. 455,822 (Weber) discloses a tong-type tool for setting an instrument sound post.

Closely related to the widely available S-shaped sound post setters, U.S. Pat. No. 6,482,239 (Jones et al.) discloses a sound post installer including a handle, a prong, and a positioning hook.

Although not as widely used commercially, various designs have been patented that include a cradle or saddle for positioning the sound post. U.S. Pat. No. 1,466,681 (Todd) discloses a violin sound post setter that includes a handle, a bent tube, a saddle, and an externally connected string. In this design, the string loops around the sound post, loops again around the bent tube, and then has a ring attached to the free end for gripping with the thumb.

U.S. Pat. No. 1,556,340 (Myers) and U.S. Pat. No. 1,559,657 (Todd) disclose sound post setting devices with cradles that wrap partially around the sound post. Although not specifically for setting an instrument sound post, U.S. Pat. No. 2,522,190 (Mouser) discloses a flexible-strap wrench for gripping round objects. A threaded rod is turned to increase the tension on the strap, thus holding the object against a front edge of the tool.

U.S. Pat. No. 2,145,237 (Eberhart) discloses a sound post with a corresponding setting tool. In this design, the sound post height is adjustable. An internal spring provides the necessary pressure force to maintain the sound post position once installed in the instrument. The setting tool is made to fit the adjustable sound post, and has a bent rod, handle, and end effector for holding the sound post.

U.S. Pat. No. 5,804,748 (Clayton) discloses a sound post installer including a wire, a frame, a cradle, a threaded rod, a nut around the threaded rod for tightening and loosening the wire around the cradle, a keyway hole, and a tab.

SUMMARY OF THE INVENTION

A tool for setting an instrument sound post preferably includes a bent tube, one or more string or polymer lines, a cradle end that grasps the sound post, and an internal locking mechanism to hold the sound post against the tool. In one embodiment, a single line is used and a closed loop at the cradle end of the sound post setting tool holds the sound post in place. In this embodiment, a double-chamfer threaded tube construction is preferably used to facilitate line threading. In another embodiment, the cradle end includes a loop and a ball to grasp the sound post. In yet another embodiment, the cradle end includes two balls to grasp the sound post. The tool provides an improved way to install a sound post inside a stringed instrument.

DETAILED DESCRIPTION OF THE INVENTION

A sound post is a piece of wood inside the body of a stringed musical instrument that connects the front and back of the instrument and is held in place by friction. The sound post provides structural support and distributes vibrations throughout the instrument.

The sound post is one of the critical components in the field of stringed musical instrument construction and repair. This is particularly true for violins, violas, cellos, and double basses. One of the primary challenges for the instrument maker or during repairs is placing the sound post, since typically it is held in place within the instrument body only by friction. To set the sound post, luthiers commonly use a sharp tool that is stabbed into the side of the wooden sound post. Once the sound post is set in place, small adjustments are made by tapping it lightly. Several other tools have been invented to replace this tool; however, each has its own drawbacks, and coupled with the long history of the luthier trade, none has found widespread acceptance.

The present invention provides a solution to many of these shortcomings by providing an improved tool for setting a sound post that allows for greater control over the placement, as well as significant reduction in the necessary skill level of the practitioner. In particular, this tool allows casual players, students, and teachers to quickly reset sound posts without the cost of hiring a master craftsman or repair shop. Some advantages of this design include ease of securing the sound post to the tool, elimination of damage to the sound post during setting, and ease of removal of the tool from the instrument once the sound post is in place.

Figure 1:
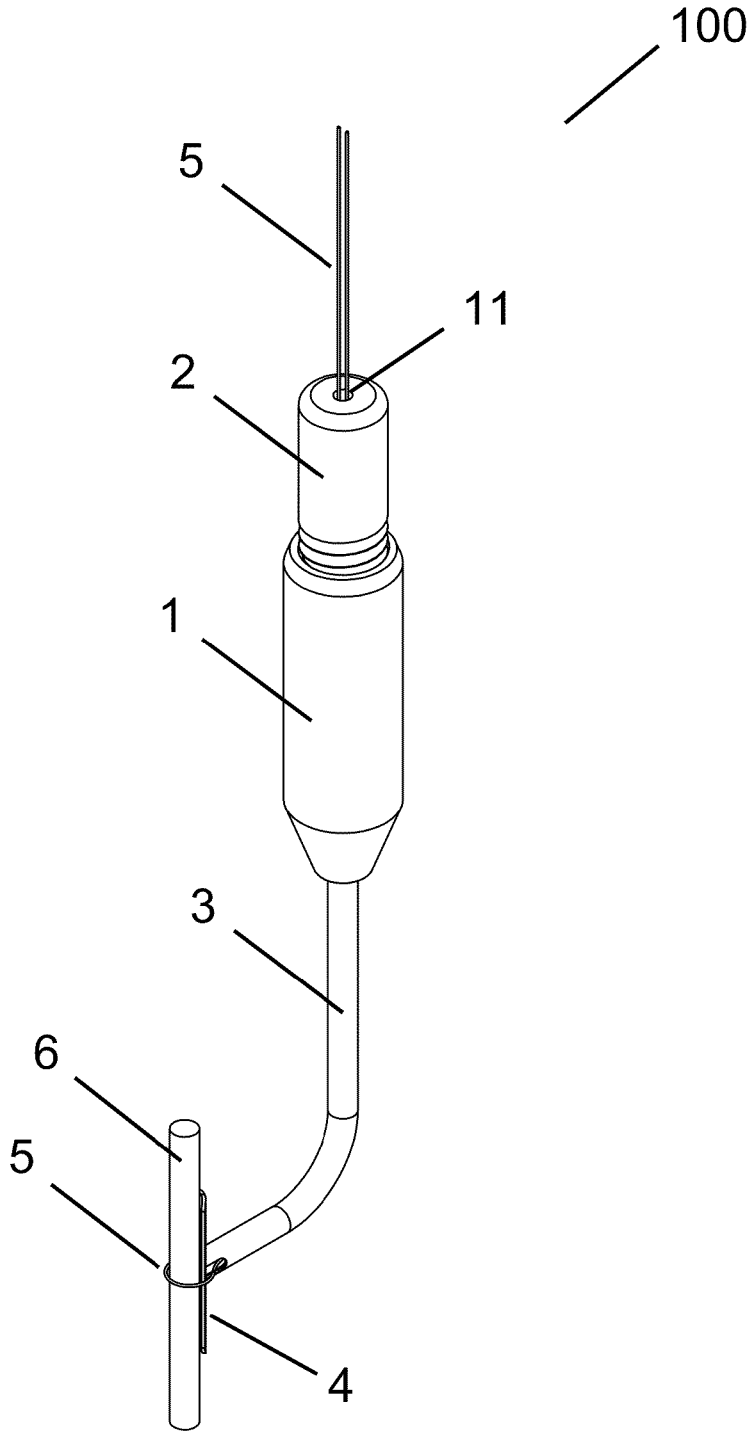
FIG. 1 shows the external features of one embodiment of a sound post setting tool of the present invention.
Figure 2:
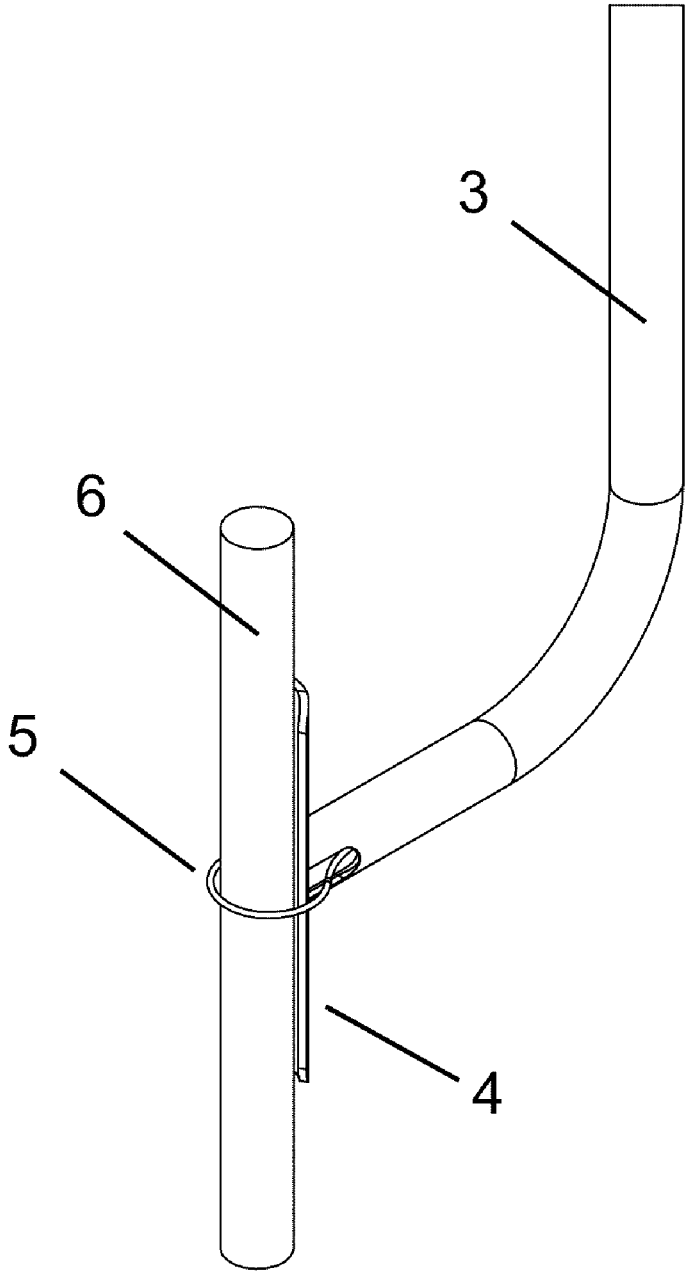
FIG. 2 shows a close-up view of the cradle end of the sound post setting tool of FIG. 1.
Figure 3A:
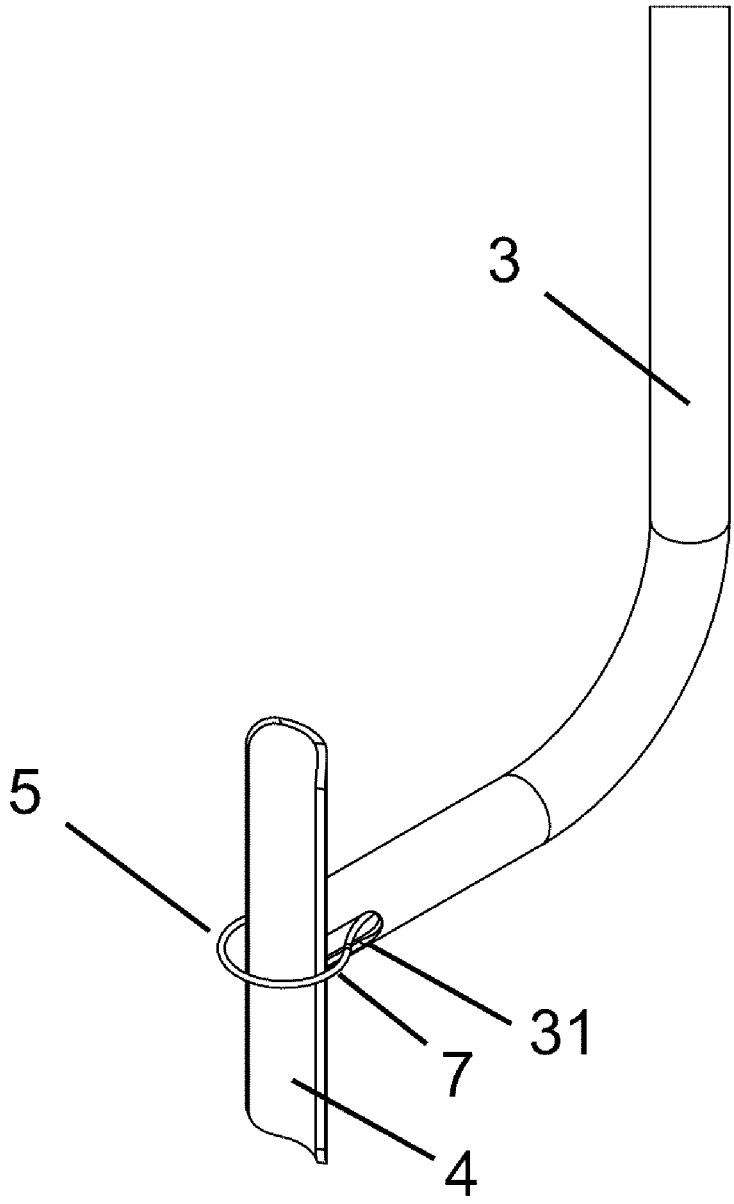
FIG. 3*a* shows the sound post setting tool of FIG. 1 with the sound post removed from the cradle.

An embodiment of the present invention is shown in FIG. 1, which shows a sound post setting tool 100. The sound post setting tool 100 includes a main body 1, a threaded tube 2 inserted into the body 1, a bent tube 3, a cradle 4, and a line 5. The line 5 can be one continuous line at the cradle end, as shown in FIG. 1, or a line that has been split or divided at the cradle end and then refastened to form a loop (see FIGS. 9, 10*a* and 10*b*). In FIG. 1, a sound post 6 is shown held in place by the cradle 4 and line 5. FIG. 2 shows a close-up of the cradle end of the sound post setting tool 100. FIG. 3*a* shows a close-up view of the cradle end with the sound post 6 removed, and FIG. 3*b* shows a close-up view of the cradle end with the sound post 6 and cradle 4 removed.

Figure 4:
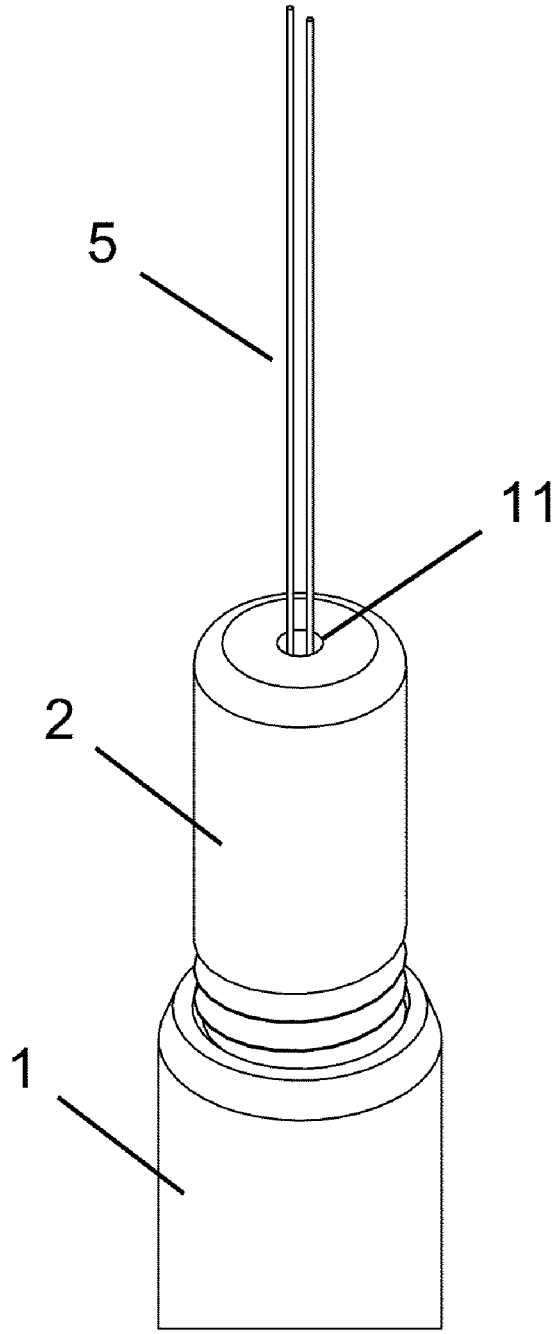
FIG. 4 shows a close-up view of the handle end of the sound post setting tool of FIG. 1.

To facilitate use of the sound post setting tool, the line 5 is first fed into the sound post setting tool starting from either the threaded tube end or the cradle end of the tool. In one example, one end of the line 5 is placed into a side slot 31 located on one side of the bent tube 3 just behind the cradle and is threaded through the bent tube 3, the main body 1, and the threaded tube 2, until it emerges from the hole 11 on the threaded tube 2. FIG. 4 shows a close-up of the threaded tube end of the sound post setting tool 100. The other end of the line 5 is then fed through the tool in the same manner starting from a second side slot 31 behind the cradle on the other side of the bent tube 3. Alternatively, one could feed the line 5 through the tool starting from hole 11 in the threaded tube, out a side slot 31, back in through the opposite side slot 31, and then returning to hole 11.

Figure 3B:
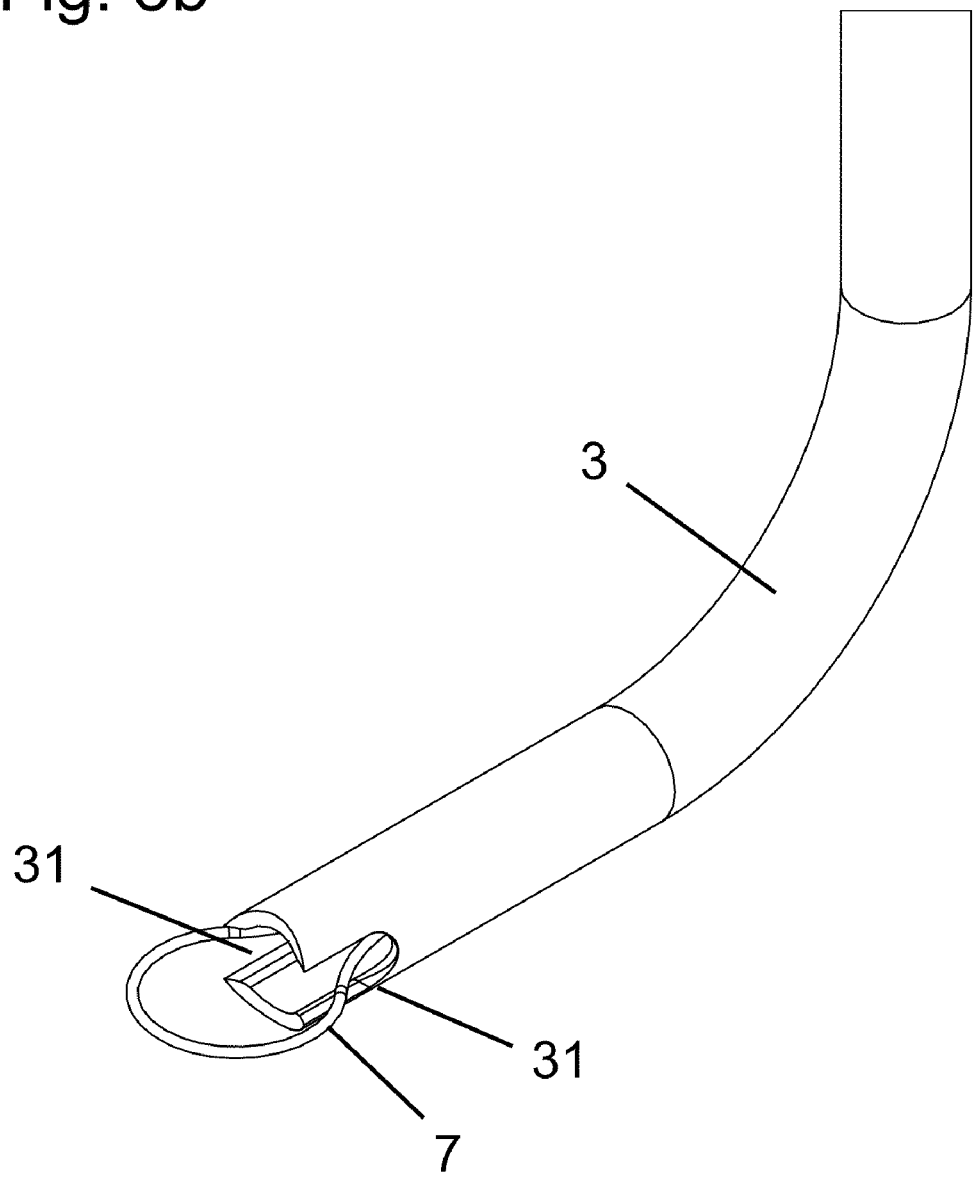
FIG. 3*b* shows another view of the sound post setting tool of FIG. 1 with the sound post and cradle removed.

In order to secure the sound post, the line 5 forms a loop 7 near the cradle 4, as shown in FIGS. 3*a* and 3*b*. In order to do this, the threaded tube 2 must be loosened approximately two turns from the tightened position, which allows the line gripping mechanism 51 (also known as a tightening ball), shown in FIG. 5*a*, to float and the line 5 not to come into contact with the threads. FIG. 5*b* shows the line gripping mechanism 51 seated at the bottom of the main body 1 of the tool. The sound post 6 is then placed inside the loop, as shown in FIG. 2, and the line 5 is pulled tight to secure the sound post 6 to the cradle 4. Once the sound post 6 is secured in place, the threaded tube 2 is tightened. With the sound post now secure, the practitioner then places the cradle end of the tool through the f-hole on the instrument and positions the sound post. Some instruments for which the tool could be used include, but are not limited to, a violin, viola, cello, or double bass. The bend in the tube 3 allows for easy insertion of the cradle end of the tool into the instrument. Once the sound post 6 is properly set in the instrument, the threaded tube 2 is loosened, the line 5 is disengaged from the sound post, and the user can remove the sound post setting tool 100 from the instrument. Alternatively, the user can loosen the threaded tube 2, and, while holding the sound post setting tool 100 in place, pull one end of the line 5 until the loop disengages from the sound post 6, thus allowing the tool 100 to be removed from the instrument.

Figure 5A:
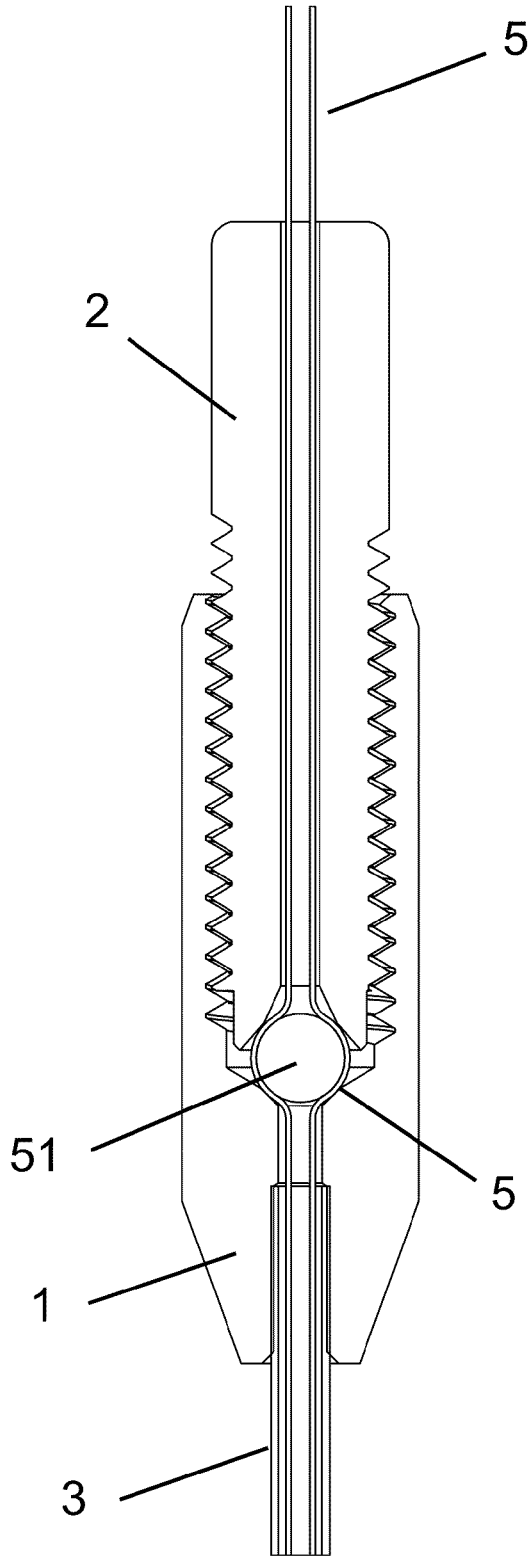
FIG. 5*a* shows a section view of the main body of the sound post setting tool of FIG. 1.
Figure 5B:
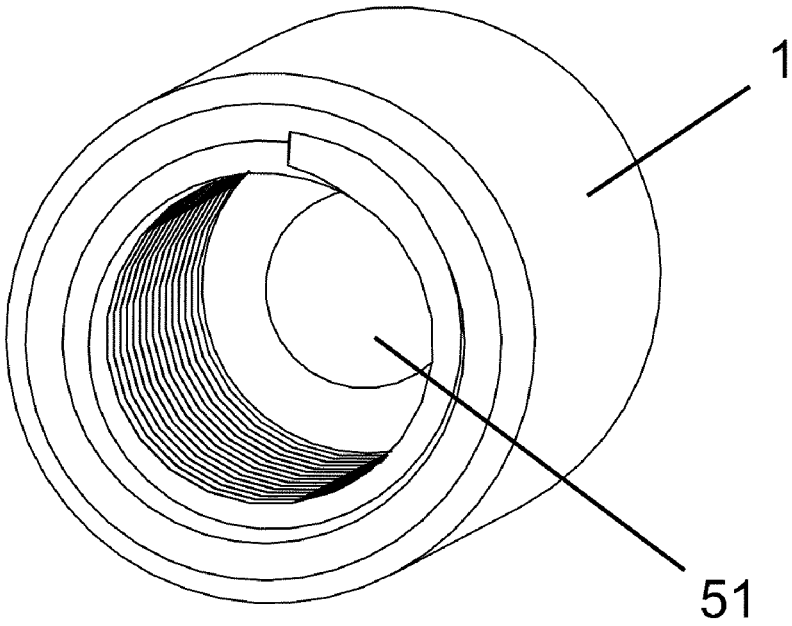
FIG. 5*b* shows a close-up view of the line gripping mechanism seated in the throat of the bottom of the main body of the sound post setting tool of FIG. 1.

As shown in FIGS. 5*a* and 5*b*, within the main body 1 is a line gripping mechanism 51 that secures the line 5 by pressing it against the inner diameter of the throat of the main body 1. The shape of the line gripping mechanism 51 is preferably round, oblate spheroid, or other similar shape. When the threaded tube 2 is screwed into the main body 1, the line gripping mechanism 51 is pressed against the line 5 by an axial force provided by the threaded tube 2. Once the line 5 is secured by the line gripping mechanism 51, the user can then release the hand tension on the line 5 without the sound post 6 falling off the cradle 4.

Figure 6:
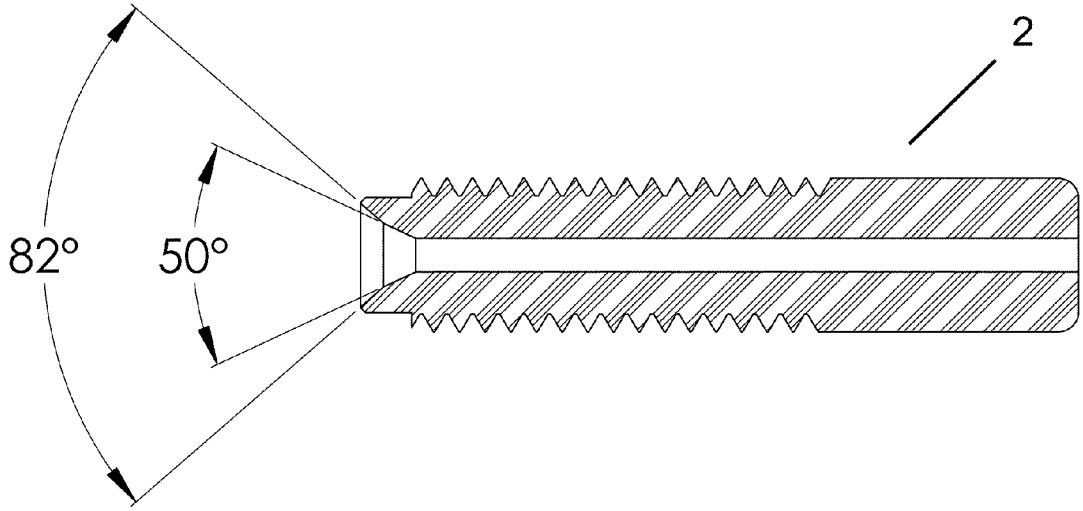
FIG. 6 shows a section view of the threaded tube of the sound post setting tool of FIG. 1.

In order to facilitate easy threading of the line through the body, a double-chamfer construction is preferably used for the threaded tube 2, as shown in FIG. 6. The preferred angles of the chamfers are labeled in the figure. Although these chamfers are preferably about 50 degrees for the inner chamfer and about 82 degrees for the outer chamfer, other angles are within the spirit of the invention. By including the outer chamfer in the threaded tube 2 design, the line gripping mechanism 51 seated against the threaded tube 2 and main body 1 will be easily bypassed by the line 5. FIG. 5*a* shows the line 5 threaded through the gap between the line gripping mechanism 51, main body 1, and threaded tube 2. Although a single-chamfer design is possible, the double-chamfer construction allows much easier utilization of a single line for securing the sound post.

Figure 7:
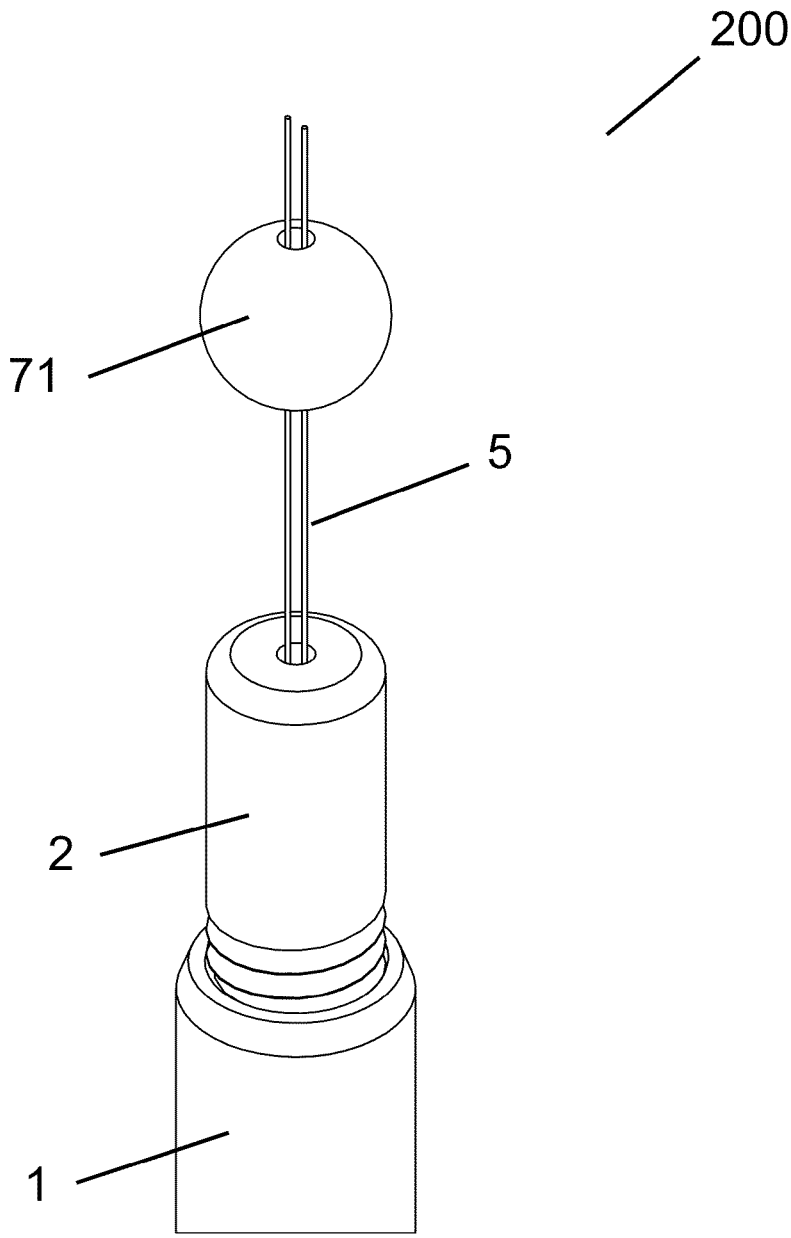
FIG. 7 shows a ball grip attached to the handle end of the sound post setting tool of FIG. 1.
Figure 8A:
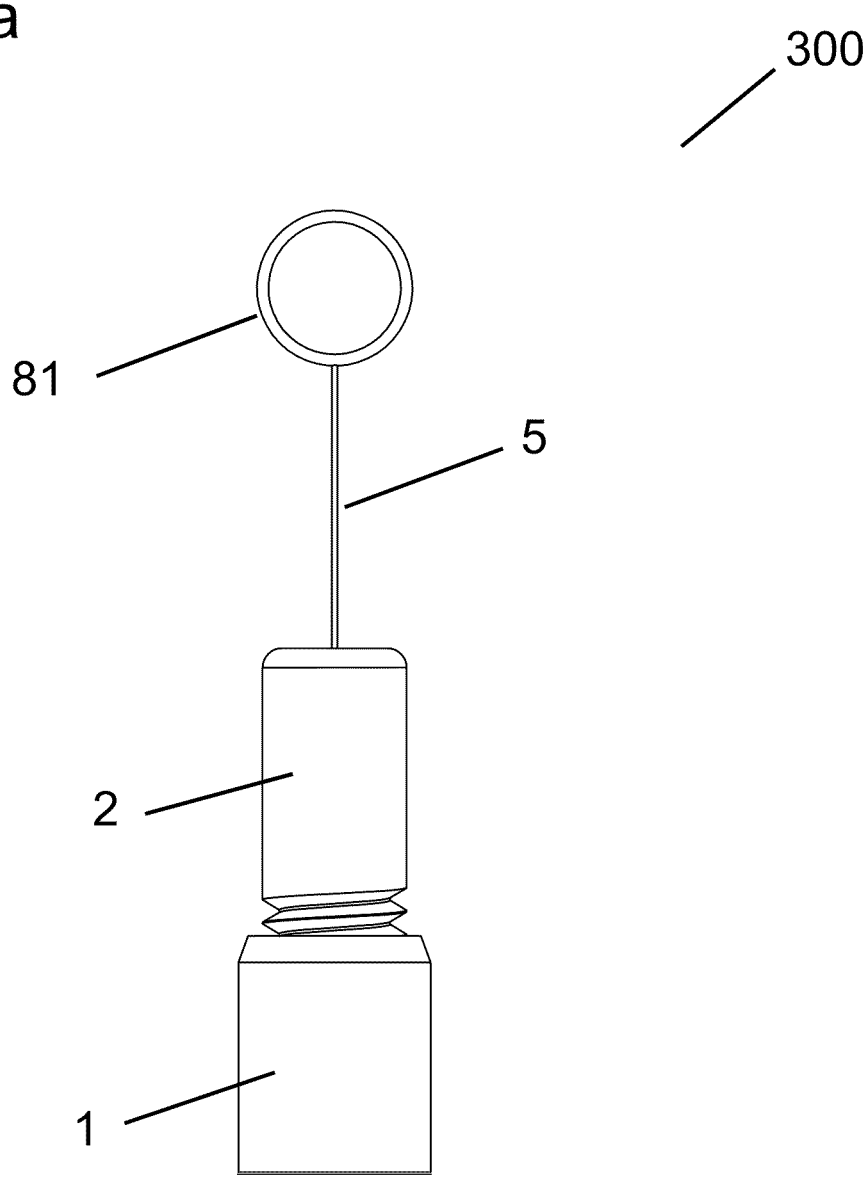
FIG. 8*a* shows a ring attached to the handle end of the sound post setting tool of FIG. 1.
Figures 8B, 8C:
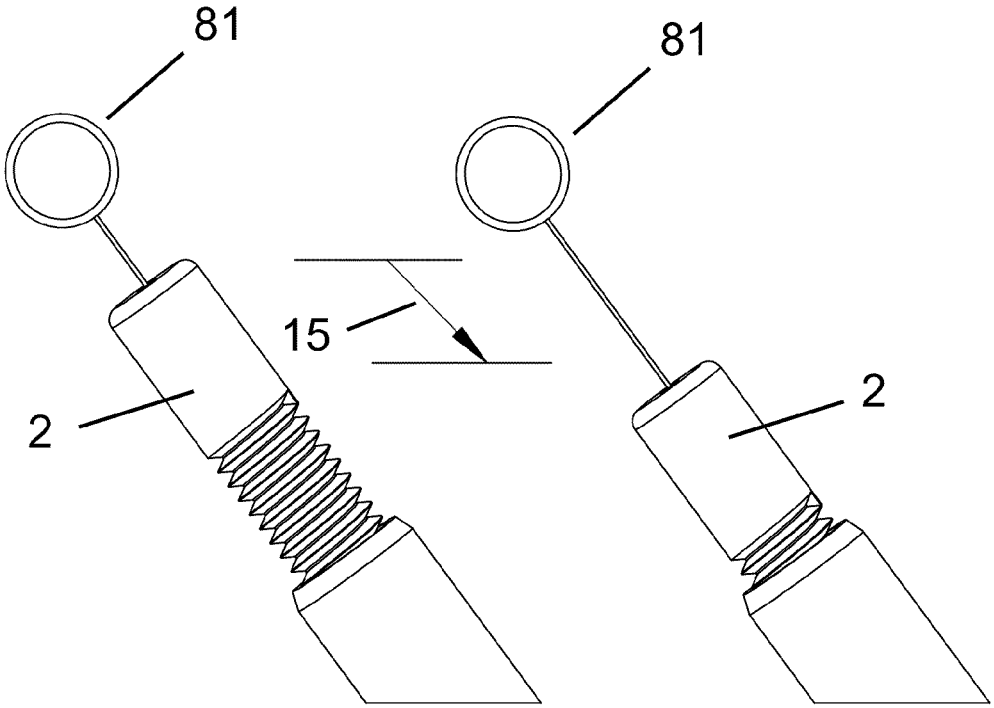
FIG. 8*b* shows the line free with the threaded tube unscrewed.
FIG. 8*c* shows the line secured with the threaded tube tightened.

FIG. 4 shows one embodiment of the present invention with no end effector to grip onto the line 5. Alternative sound post setter tools 200 and 300 that include components to grip the line 5 are shown in FIGS. 7 and 8*a*-8*c*, respectively. In FIG. 7, a ball 71 is attached to the line 5. In FIG. 8*a*, a ring 81 is attached to the line. FIG. 8*b* shows the line 5 free when the threaded tube 2 is unscrewed. When the threaded tube 2 is tightened 15, the line 5 is secure. In use, an instrument sound post is first placed into the cradle 4, as shown in FIG. 3. The ball 71 or ring 81 is pulled to tighten the line 5 against the sound post 6.

While the figures show two divided strands of line 5 at the threaded tube end of the sound post setting tool, in alternative embodiments, a single continuous strand of line 5 at the threaded tube end could be used. These embodiments could be used with the loops described below with reference to FIGS. 9, 10*a* and 10*b*. In these embodiments, both ends of the continuous line would be initially threaded through the sound post setting tool at the threaded tube end before the balls 92 or rings 91 were affixed to the line.

Figure 9:
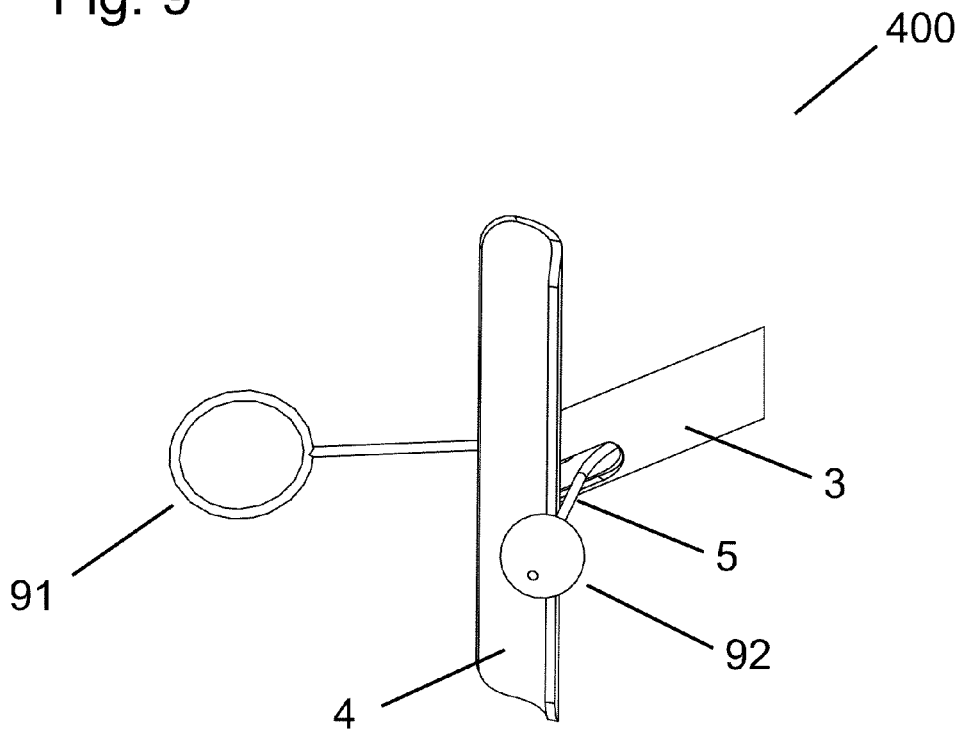
FIG. 9 shows a ball and loop embodiment of the cradle end of the line.
Figure 10A:
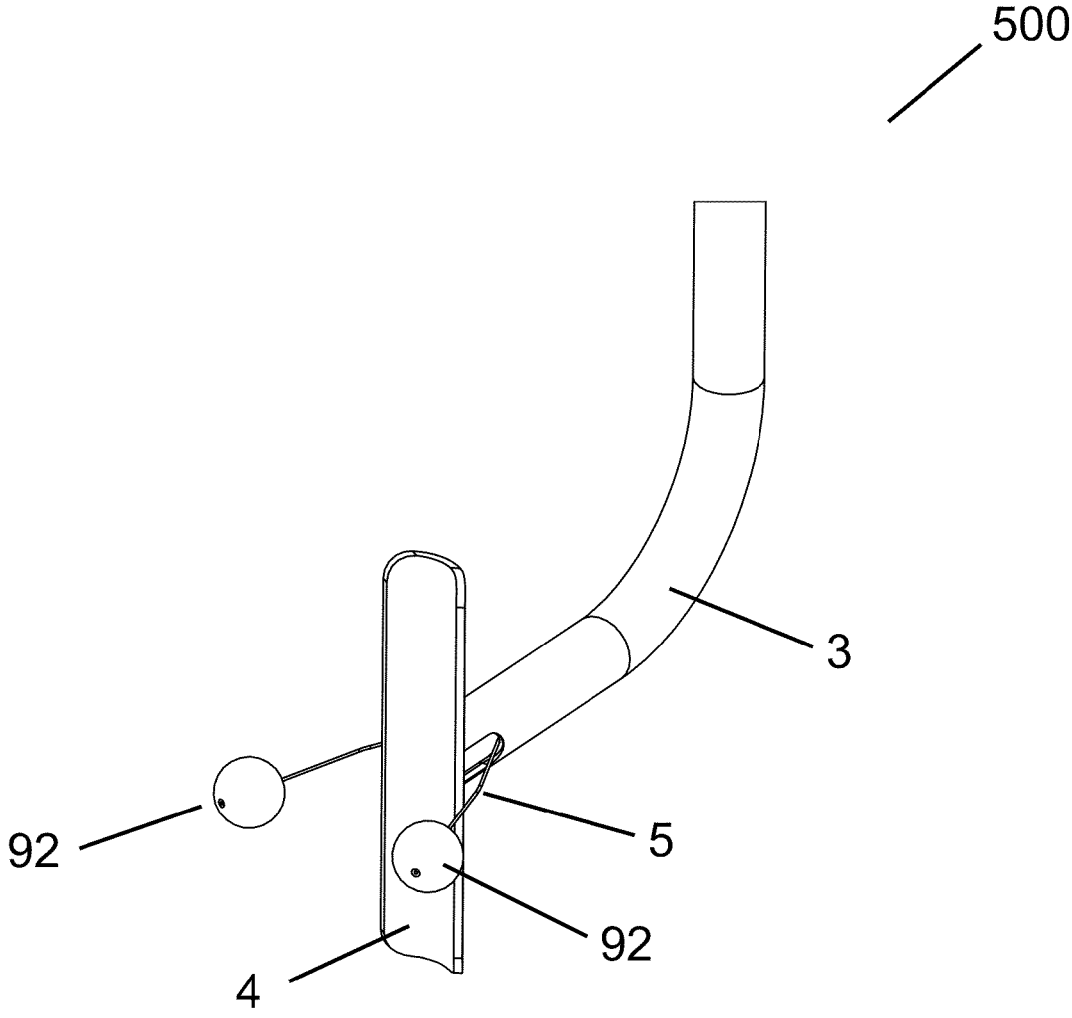
FIG. 10*a* shows another cradle end embodiment with dual ball line ends.
Figure 10B:
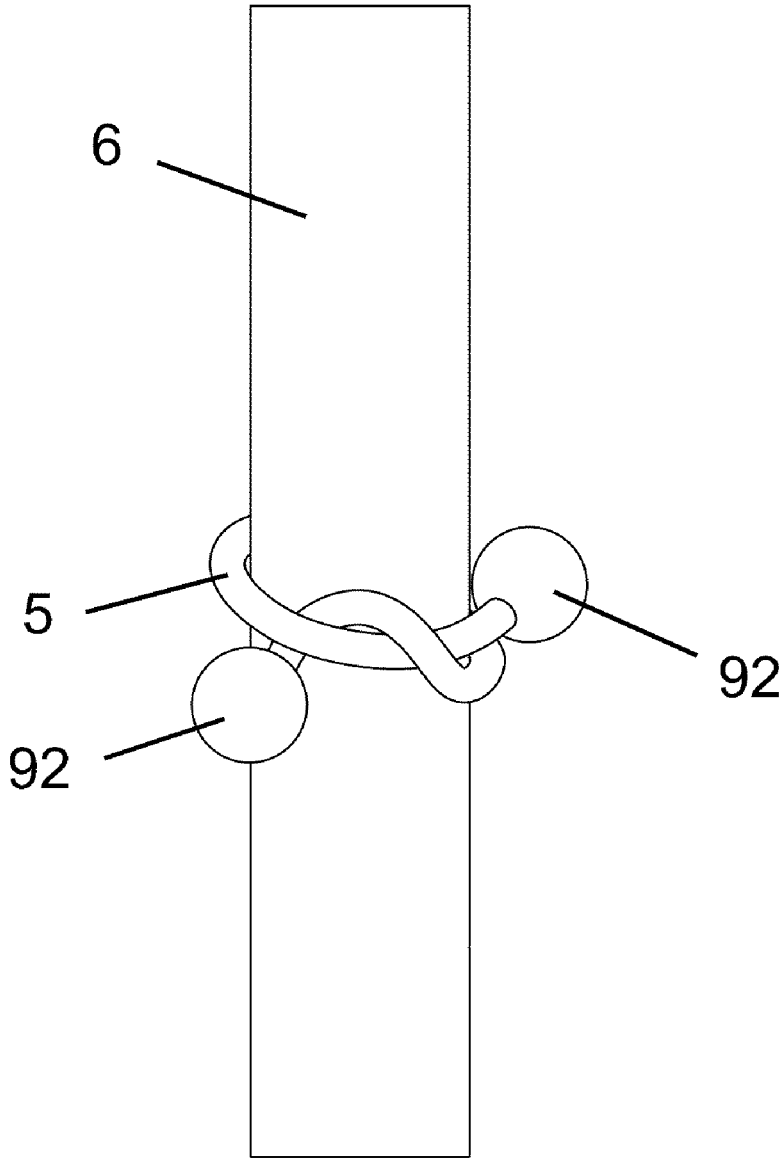
FIG. 10*b* shows the dual ball ends secured around a sound post.

The sound post setter tools of the present invention include a loop to grasp the sound post. The loop may be a continuous loop 7, but alternative loops are also possible. FIG. 9 shows another sound post setter tool 400 with an alternative loop which grips the sound post. In this embodiment, the loop 7 is replaced by a small ring or loop ring 91 on one side of the cradle 4 and a small ball 92 or similar shape attached to the line 5 on the opposite side of the cradle 4. In this embodiment, the ball 92 is placed through the ring 91 to form a loop that wraps around the cradle 4 and the sound post 6. When the line 5 is pulled taut, the ball 92 catches on the ring 91 and provides the tension to keep the sound post against the cradle 4. In an alternative sound post setter tool 500, the ring 91 is replaced by a second ball 92, as shown in FIGS. 10*a* and 10*b*. In this embodiment, the two balls are twisted together to form a loop to grasp the sound post, as shown in FIG. 10*b*.

Figure 11:
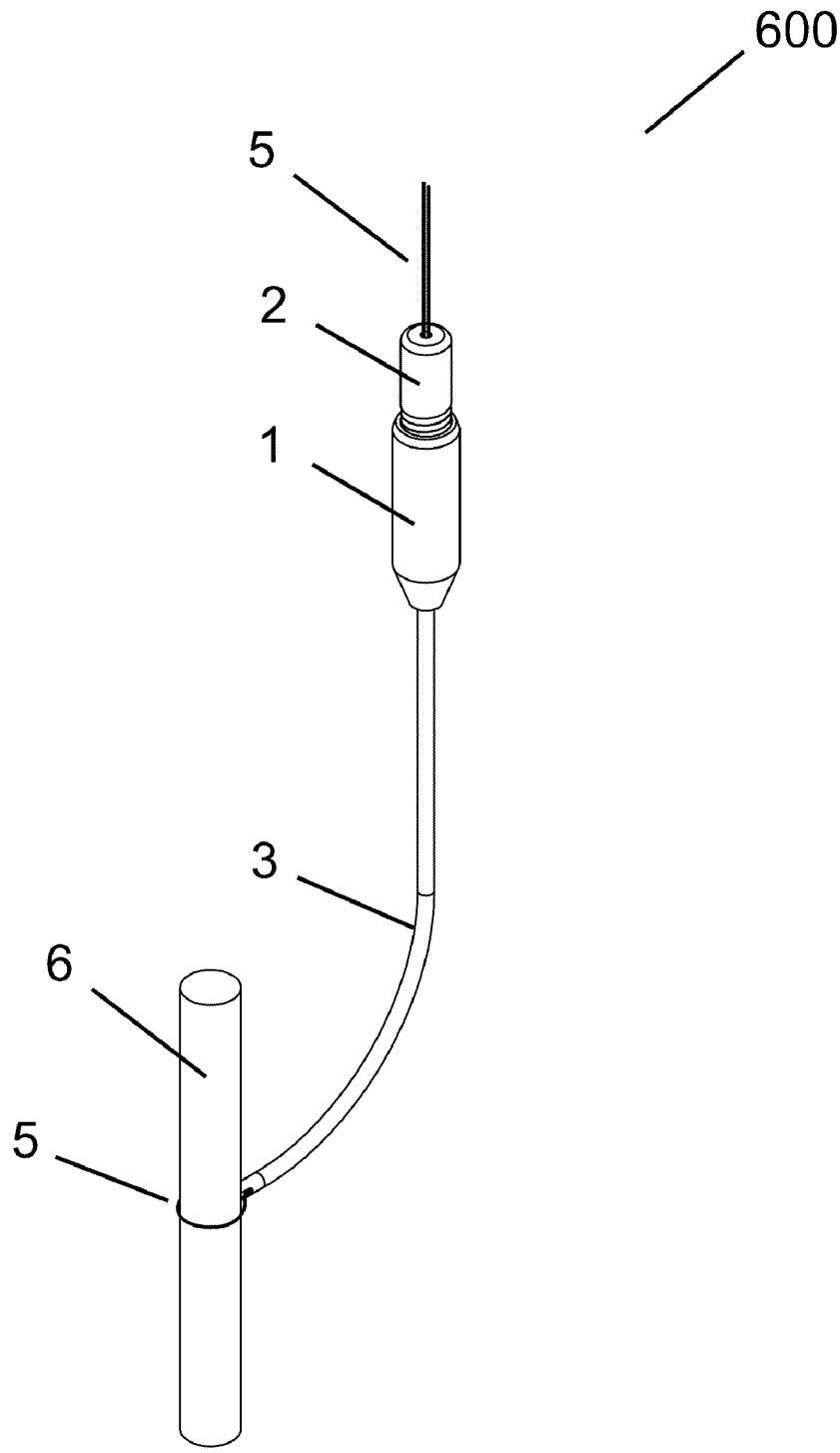
FIG. 11 shows a cello or bass sound post setter of the present invention.

The sound post setting tool shown in FIG. 1 is preferably used to set sound posts in violins and violas. Within the spirit of the invention, the sound post setting tool can be sized to accommodate other stringed instruments with sound posts, including but not limited to cellos and double basses. An example of a larger tool 600 used for setting sound posts in cello and double bass instruments is shown in FIG. 11. The primary difference here is an elongated bent tube 3; however, other components can be sized larger or smaller depending on the particular instrument.

Figure 12:
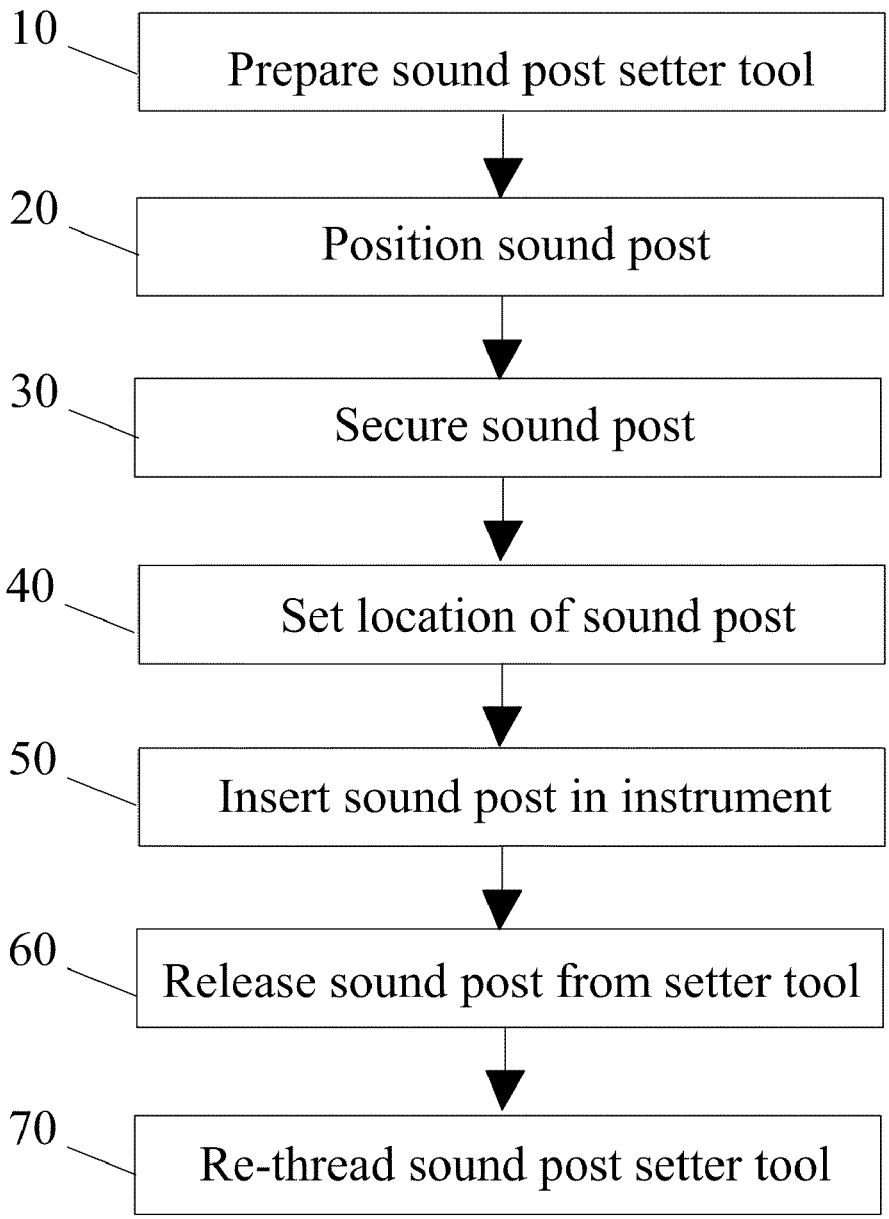
FIG. 12 shows a flowchart of a method of setting a sound post in a musical instrument.

An example of a method of replacing or resetting a sound post in a stringed musical instrument using a sound post setting tool of the present invention is shown in FIG. 12. While this method is described with reference to the sound post setter tool 100 shown in FIG. 1, similar methods could be used with other embodiments of the sound post setter tool.

In a first step 10, the sound post setter tool 100 is prepared. During this step, a user checks to see that both ends of the line 5 are threaded through the setter tool. As one example using the sound post setter tool 100, the user could thread the line 5 by forming a loop 7 around the cradle 4 and then threading the ends of the line through the slots 31 on the sides of the bent tube 3, through a channel formed in the bent tube 3, main body 1 and threaded tube 2, and out through the hole 11, as shown in FIG. 1. Alternatively, the user could thread the line 5, starting at the hole 11, threading the line through a channel formed in the threaded tube 2, the main body 1, and the bent tube 3, exiting through one of the side slots 31. The line 5 is then looped around the cradle 4, and threaded back through the other side slot 31. The line 5 then passes through the bent tube 3, main body 1, and threaded tube 2 a second time, exiting out the hole 11.

During the second step 20, the sound post 6 is positioned in the sound post setter tool 100. The threaded tube 2 is loosened to allow the line to move freely. The sound post 6 is then positioned in the cradle 4. The line 5 is then tightened around the sound post 6 to secure the sound post 6 in step 30. When the threaded tube 2 is tightened by screwing it into the main body 1, the line gripping mechanism 51 is pressed against the line 5 by an axial force provided by the threaded tube 2. Once the line 5 is secured by the line gripping mechanism 51, the user can then release the hand tension on the line 5 without the sound post 6 falling off the cradle 4.

The location of the sound post 6 is then set in step 40. To set the location, the user should hold the sound post setter tool 100 vertically over the instrument with the sound post 6 over the setting location and the main body 1 of the sound post setter tool 100 over the f-hole of the instrument. The user loosens the sound post 6 slightly and rotates the sound post 6 in the setter tool so the angles on the top and bottom match the curvature of the top and back. The sound post 6 is then retightened. The user needs to note the position of the setter tool 100 as this will be the position he will match when setting the post.

The sound post 6 is inserted into the instrument in step 50. With the sound post 6 now securely in the setter tool 100, the sound post 6 and setter tool 100 are carefully inserted through the f-hole in the instrument. The sound post 6 is worked into position holding it vertical and gently pulling the sound post 6 towards the user until the user feels it wedge into position.

The sound post 6 is released in step 60. When the sound post is securely in position between the top and back, the threaded tube 2 is loosened and a free end of the line is captured. The sound post setter tool 100 is gently removed from the instrument. One line will pull free from the setter tool and release the sound post 6 during this step.

The tool is re-threaded in step 70. In the example using the sound post setter tool 100 of FIG. 1, to re-thread the line 5, the threaded tube is loosened approximately 2-3 turns. The tube is held in a slightly downward position and the free end of the line is threaded into the empty hole and pushed through the main body of the sound post setting tool 100.

When the tool is not in use, it is preferable to release the tension on the threaded body 2. When necessary, line 5 can be replaced with any monofilament line that threads through the sound post setter tool. One preferred example is approximately 10 lb. test monofilament line.

The sound post setting tool is preferably made from materials including, but not limited to, metal and/or plastic. It is preferably made from a non-abrasive or cushioned material to prevent damage to the instrument. Additionally, a cushioned sleeve may be used to cover the metal portions of the tool, further reducing the risk of damage to the instrument. The lines, which are preferably composed of either two separate lines or a single line passing through the channel twice, are preferably polymeric lines, such as fishing lines, polymeric strings, wires, or an equivalent material.

Accordingly, it is to be understood that the embodiments of the invention herein described are merely illustrative of the application of the principles of the invention. Reference herein to details of the illustrated embodiments is not intended to limit the scope of the claims, which themselves recite those features regarded as essential to the invention.

What is claimed is:

1. A sound post setting tool comprising:

a) a main body having a first main body end, a second main body end and a channel therebetween;

b) a threaded tube having a first threaded tube end screwed into the first main body end, a second threaded tube end having a threaded tube hole, and a channel therebetween;

c) a bent tube having a first bent tube end inserted into the second end of the main body, a second bent tube end having a slot on each side, and a channel therebetween;

d) a cradle shaped to fit a sound post and located at the second bent tube end; and e) a line passing through the channels of the main body, the threaded tube, and the bent tube, forming a loop around the cradle and returning through the channels of the main body, the threaded tube, and the bent tube a second time, wherein the line exits the channels through the slots on the second bent tube end and the threaded tube hole.

2. The tool of claim 1, wherein the loop is formed by one continuous line.

3. The tool of claim 1, wherein the loop is formed by a ring and a ball interlocking to wrap around the sound post.

4. The tool of claim 1, wherein the loop is formed by a first ball and a second ball wrapped around the sound post.

5. The tool of claim 1, further comprising a line gripping mechanism within the channel of the main body that presses the line against an inner diameter of a throat of the main body.

6. The tool of claim 5, wherein the line gripping mechanism is a round ball.

7. The tool of claim 5, wherein the channel of the threaded tube comprises at least one chamfer.

8. The tool of claim 5, wherein the channel of the threaded tube comprises an inner chamfer and an outer chamfer.

9. The tool of claim 8, wherein the inner chamfer is approximately 50 degrees.

10. The tool of claim 8, wherein the outer chamfer is approximately 82 degrees.

11. The tool of claim 1, further comprising a ball at an end of the line that exits the hole in the threaded tube.

12. The tool of claim 1, further comprising a loop at an end of the line that exits the hole in the threaded tube.

13. The tool of claim 1, wherein the line comprises a single continuous strand of line.

14. The tool of claim 1, wherein the line comprises two separated strands of line that are fastened to form the loop at a cradle end of the tool.

15. A method of setting a sound post in a musical instrument using a sound post setting tool comprising a main body having a first main body end, a second main body end and a channel therebetween, a threaded tube having a first threaded tube end screwed into the first main body end, a second threaded tube end having a threaded tube hole and a channel therebetween, a bent tube having a first bent tube end inserted into the second end of the main body, a second bent tube end having a slot on each side, and a channel therebetween, a cradle shaped to fit a sound post and located at the second bent tube end and a line forming a loop around the cradle and passing through the channels of the main body, the threaded tube, and the bent tube twice, comprising the steps of:

a) inserting a sound post in the cradle;

b) securing the sound post by tightening a loop created by the line around the sound post;

c) inserting the sound post into the musical instrument using the sound post setting tool; and d) releasing the sound post from the loop.

16. The method of claim 15, further comprising, before step a), the step of e) threading the line through the channels of the main body, the threaded tube, and the bent tube such that the line passes through the channels twice and exits the channels through the slots on the second bent tube end and the threaded tube hole.

17. The method of claim 16, wherein step e) comprises the substep of running the line past a line gripping mechanism within the channel of the main body that presses the line against an inner diameter of a throat of the main body.

18. The method of claim 17, wherein the channel of the threaded tube comprises at least one chamfer.

19. The method of claim 18, wherein the channel of the threaded tube comprises an inner chamfer and an outer chamfer.

20. The method of claim 19, wherein the inner chamfer is approximately 50 degrees.

21. The method of claim 19, wherein the outer chamfer is approximately 82 degrees.

22. The method of claim 15, wherein step b) includes the substep of screwing the threaded tube further into the main body to tighten the loop.

23. The method of claim 22, wherein step d) includes the substep of partially unscrewing the threaded tube from the main body to loosen the loop.

* * * * *